United States Patent [19]

Powell

[11] Patent Number: 5,031,581

[45] Date of Patent: Jul. 16, 1991

[54] CRANKLESS RECIPROCATING MACHINE

[76] Inventor: Brian L. Powell, "Kalandan", Peak View, New South Wales, 2630, Australia

[21] Appl. No.: 394,136

[22] Filed: Aug. 15, 1989

[30] Foreign Application Priority Data

Aug. 29, 1988 [AU] Australia ..... PJ0082

[51] Int. Cl.[5] ..... F02B 75/26

[52] U.S. Cl. ..... 123/58 AM

[58] Field of Search ..... 123/58 AM, 58 BC, 56 AC, 123/56 C, 56 BC, 58 A, 58 AB

[56] References Cited

U.S. PATENT DOCUMENTS

| | | | |
|---|---|---|---|
| 1,788,140 | 1/1931 | Woolson | 123/51 AA |
| 1,808,083 | 6/1931 | Tibbetts | 123/58 AM |
| 1,819,826 | 8/1931 | Sherman | 123/51 AA |
| 1,976,286 | 10/1934 | Kreidler | 123/58 AM |
| 2,076,334 | 4/1937 | Burns | 123/58 AM |
| 2,457,183 | 12/1948 | Sherman | 123/58 BC |
| 3,385,051 | 5/1968 | Kelly | 123/58 AM |
| 3,456,630 | 7/1969 | Karlan | 123/58 AM |
| 4,516,536 | 5/1985 | Williams | 123/58 AM |

FOREIGN PATENT DOCUMENTS

| | | | |
|---|---|---|---|
| 879624 | 4/1953 | Fed. Rep. of Germany | 123/58 AM |

*Primary Examiner*—David A. Okonsky

*Attorney, Agent, or Firm*—Kane, Dalsimer, Sullivan, Kurucz, Levy, Eisele & Richard

[57] ABSTRACT

The machine (e.g. an internal combustion engine or pump) has at least one cylinder 4 housing two opposed pistons 5 adapted to reciprocate in opposite directions and a common working chamber 13. A main shaft 1 carries two contoured tracks 3 each having opposed, axially facing, endless, substantially sinusoidal cam surfaces. Bearings 8 and 9 mounted on connecting rod 6 abut the cam surfaces so that reciprocation of pistons 5 imparts rotary motion to main shaft 1, or vice versa.

17 Claims, 6 Drawing Sheets

CRANKLESS RECIPROCATING MACHINE

FIELD OF INVENTION

The invention relates to a crankless reciprocating machine having one or more cylinders, each of which houses two opposed pistons arranged to reciprocate in opposite directions along the longitudinal axis of the cylinder. A main shaft is disposed parallel to, and spaced from, the longitudinal axis of each cylinder. The main shaft and pistons are so interconnected that reciprocation of the pistons imparts rotary motion to the main shaft or vice versa.

The machine of the invention may be an internal combustion engine and, in particular, a two stroke internal combustion engine. Engines may be adapted to a wide range of fuels such as petrol, diesel or gas. It is also within the scope of this invention to adapt the machine for use as a steam engine or an engine employing compressed gas. Further, the machine may be adapted to operate as a compressor or pump.

DESCRIPTION OF THE PRIOR ART

Conventional reciprocating machines generally use a crank mechanism to convert reciprocating motion into rotary motion or vice versa. Crank mechanisms entail energy loss causing lower efficiency and the inherent imbalance of them causes noise, vibration and wear. Generally, it is necessary to employ balancing counterweights.

It has been proposed in U.S. Pat. No. 3,598,094 (ODAWARA) to provide a crankless reciprocating machine with a mechanism for converting a reciprocating motion into a rotary motion or vice versa. The mechanism comprises a pin rigidly connected to a piston and extending radially outwardly therefrom. An endless cam groove is formed in a part which surrounds the piston. The pin travels in the endless cam groove so that reciprocating motion of the piston produces rotary motion of a rotating part.

The use of a pin running in an endless groove is also described in U.S. Pat. Nos. 1,529,687 (BOWEN), 2,401,466 (DAVIS ET AL) and 4,090,478 (TRIMBLE).

These suffer a disadvantage that forces acting on the pin change direction on each occasion the piston reverses direction. This results in a wear problem and loss of movement control. These engines involve complexities in construction, particularly in the cylinders.

BRIEF SUMMARY OF INVENTION

It is an object of the invention to provide an internal combustion engine having means other than a crank mechanism to convert reciprocating motion to rotary motion and does not involve the deficiency of a pin running in an endless cam groove.

The invention provides a two stroke sinusoidal or modified swashplate internal combustion engine. The engine is sinusoidal in that conventional crank shaft design is replaced by an endless sinusoidal or substantially sinusoidal track. A sinusoidal track may be used to produce perfect simple harmonic motion.

Alternatively, by modifying the configuration of the track, the motion of the pistons may also be modified. Thus, by employing a substantially sinusoidal track, a designer is able to dictate the motion of the pistons.

A crankless reciprocating machine comprises at least one cylinder, two opposed pistons arranged to reciprocate in opposite directions along the longitudinal axis of each cylinder, the pistons defining a common working chamber therebetween, a main shaft disposed parallel to, and spaced from, the longitudinal axis of each cylinder, two axially spaced, endless, substantially sinusoidal tracks carried by the main shaft for rotation therewith, said tracks being interconnected with said pistons so that reciprocation of the pistons imparts rotary motion to the main shaft and vice versa, characterised in that said substantially sinusoidal tracks are axially spaced from each cylinder and each comprises a radially extending flange contoured in an axial direction to define the endless, substantially sinusoidal track, the radially extending faces of the flange forming opposed, axially facing, endless, substantially sinusoidal cam surfaces, a connecting rod connected at one end to each piston, bearing means carried toward the other end of said connecting rod, said bearing means abutting each of the two opposed axially facing cam surfaces.

The internal combustion engine may have a single cylinder with two opposed pistons which reciprocate in opposite directions along the longitudinal axis of the cylinder. Alternatively, the engine may have a plurality of such cylinders. In either case, the axis of each cylinder is arranged parallel to the drive shaft and spaced therefrom. In the case of three or more cylinders, they may be arranged in a circle around the drive shaft. The engine is dynamically balanced regardless of the number of cylinders. Each cylinder is itself dynamically balanced and requires no counterweights.

BRIEF DESCRIPTION OF THE DRAWINGS

The invention is now described with reference to the accompanying drawings in which.

DETAILED DESCRIPTION

Figure 1:
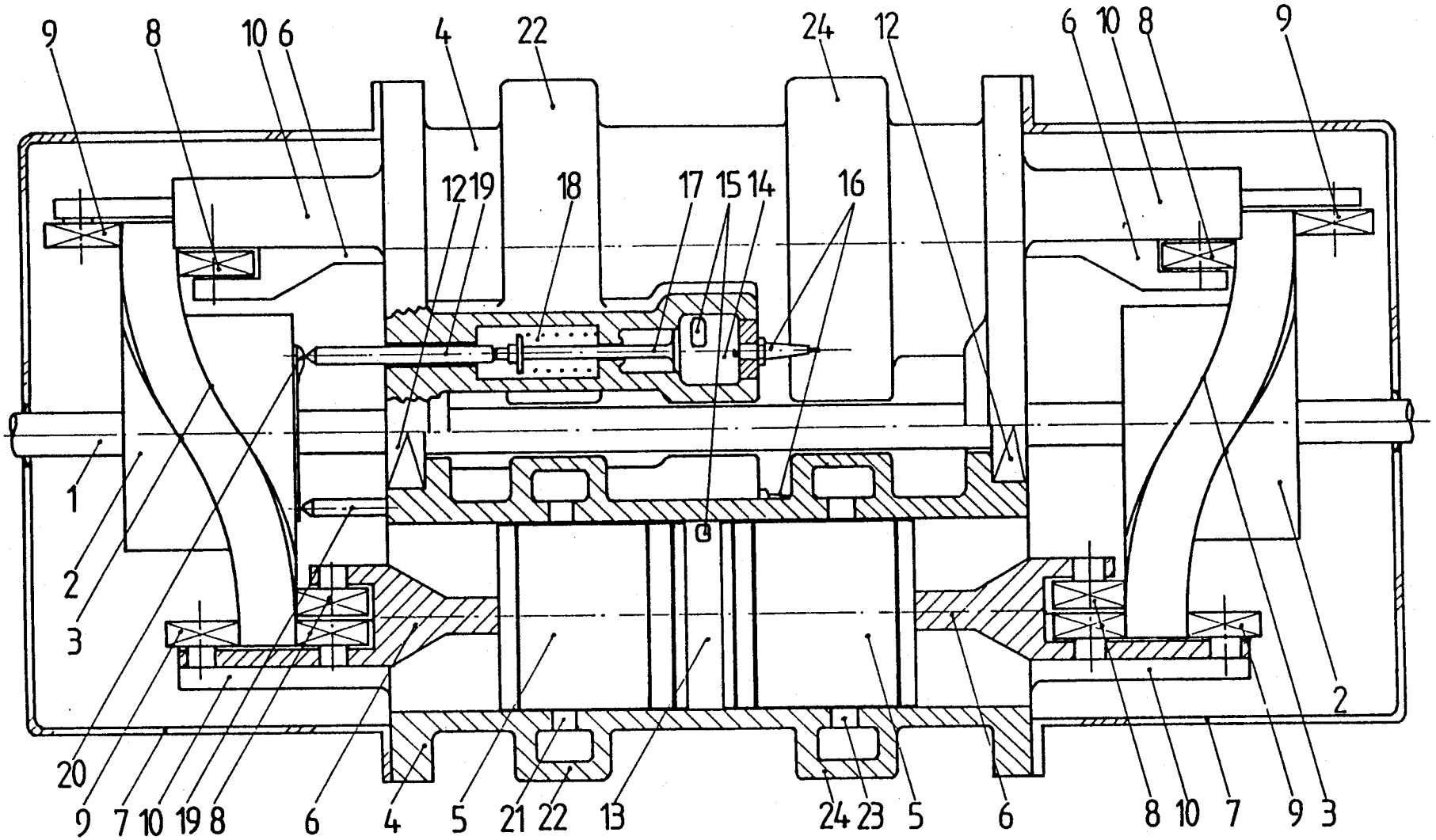
FIG. 1 illustrates one embodiment of the invention and shows a part plan - part sectional view of a two stroke internal combustion engine having two cylinders.

In FIG. 1, the section plane is through the centre line of the lower cylinder and through both sumps. There is also a part section through the centre line on the poppet valve chamber on the upper cylinder.

The two stroke internal combustion engine illustrated in FIG. 1 comprises two cylinders 4 disposed on opposite sides of a main shaft 1 which is mounted for rotation about a horizontal axis in bearings 12. In the description and claims, the terms "axial" and "radial" have reference to the longitudinal axis of main shaft 1.

Fixed to main shaft 1 for rotation therewith is a pair of spaced wheels 2 having similar outer cylindrical surfaces. Each wheel 2 has a radial flange 3 extending radially outwardly from its cylindrical surface. Flange 3 is contoured in an axial direction so that it traces an endless, substantially sinusoidal path around the cylindrical surface of wheel 2. The two flanges 3 are identical, one being the mirror image of the other. The radial surfaces of flange 3 form two, opposed, axially facing cam surfaces each of which also traces an endless, substantially sinusoidal path around wheel 2.

Each cylinder 4 and its reciprocating pistons 5 are of the same construction. However, in FIG. 1 the pistons 5 in the top cylinder 4 operate 180° out of phase with the pistons 5 in the bottom cylinder 4. The description will mainly be made in reference of one cylinder 4.

Mounted within each cylinder 4 is a pair of opposed pistons 5 which are adapted to reciprocate in opposite directions along the longitudinal axis of cylinder 4. Rigidly connected to each piston 5 is a connecting rod 6 which is adapted to co-operate with an endless sinusoidal track 3 by way of two drive bearings 8 and a tail bearing 9. The engine is closed at each end by sump casings 7.

Figure 2:
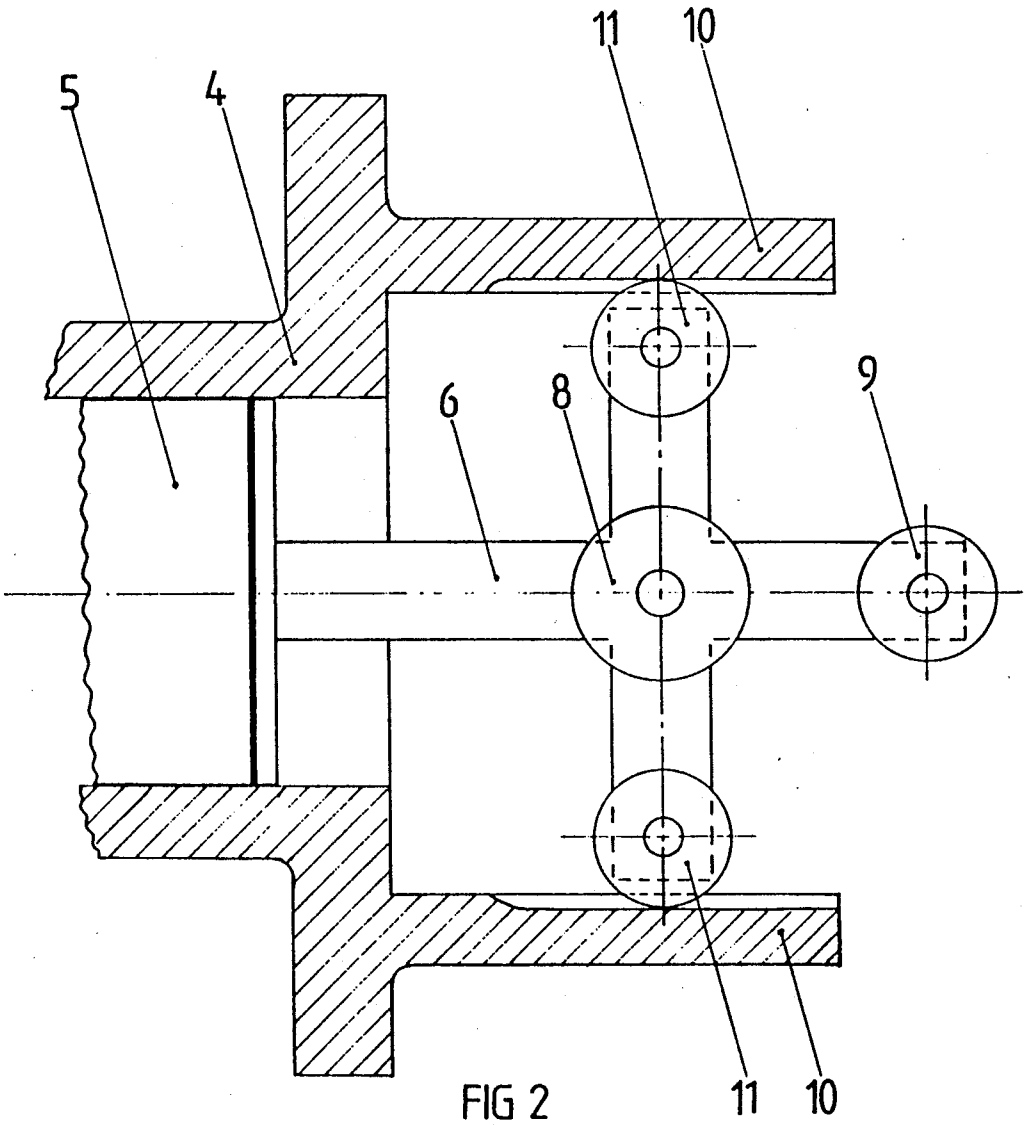
FIG. 2 shows a sectional view (normal to the section of FIG. 1) of the connecting rod guide system of the engine of FIG. 1.

As shown in FIG. 1, the distal end of connecting rod 6 is bifurcated to provide a mounting for one drive bearing 8 on each arm. The outer of the bifurcated arms extends beyond sinusoidal flange 3 to provide a mounting for tail bearing 9. As shown in FIG. 2, the outer bifurcated arm of connecting rod 6 has two lateral arms to provide mountings for a pair of guide bearings 11 which run in parallel tracks 10 formed in members which are integral with cylinder 4 and project outwardly at the end thereof. Guide bearings 11 are firmly supported in tracks 10 and thus resist unwanted movement of connecting rod 6 and rotation of piston 5 in its cylinder 4. Drive bearings 8 and tail bearing 9 abut respective opposed, axially facing, cam surfaces of flange 3, which is firmly held between the bearings to minimise any unwanted movement therebetween. To compensate for the sinusoidal curvature of flange 3, and to match the thickness of flange 3 with the spacing between drive bearings 8 and tail bearing 9, it is preferred to form flange 3 with a continuously variable thickness. In the position shown in FIG. 1, flange 3 is thickest at the top and bottom portions and thinner therebetween. In addition, it is also preferred to taper flange 3, drive bearings 8 and tail bearing 9 so as to provide a uniform relative velocity across the contact faces and thus minimising wear.

Pistons 5 define a common combustion chamber 13 therebetween. Mounted adjacent to each cylinder is a charge and ignition chamber 14 (fuel rich chamber) provided with an orifice 15 for communication with the combustion chamber 13. A spark plug 16 is mounted on chamber 14 for ignition of fuel therein. A poppet valve 17 controls the admission of fuel into the charge and ignition chamber 14. The condition of poppet valve 17 is controlled by a valve spring housed in chamber 18 and by a push rod 19 whose position is controlled by a cam 20 on the left wheel 2. A similar cam is not required on right wheel 2.

Cylinder 4 is provided with a scavenge port 21 communicating with a scavenge manifold 22 and an exhaust port 23 communicating with an exhaust manifold 24.

Figure 3:
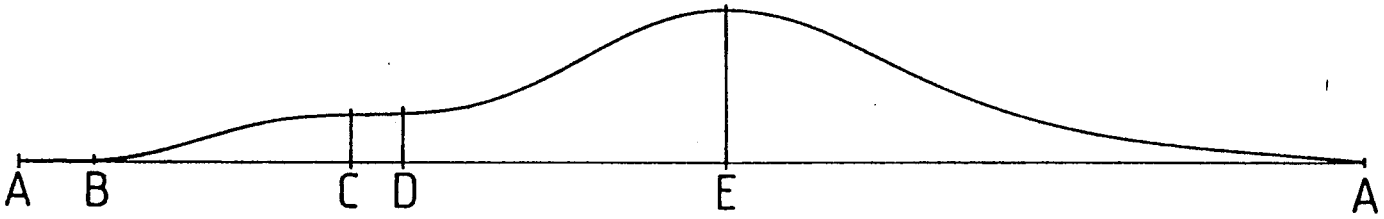
FIG. 3 is a graphical representation of the piston motion during a complete two stroke cycle of the engine of FIG. 1.

Operation of the engine is described in relation to petrol or gas fuel. The graph of FIG. 3 represents piston motion during one revolution of shaft 1 when a two stroke cycle is completed. From points A to B, tracks 3 are modified to allow pistons 5 to remain at outer dead centre while sinusoidal tracks 3 continue to rotate under the influence of rotational inertia, supplied by the wheels 2 and, if desired, by an external fly wheel (not shown). For scavenging purposes, an air blast is supplied by an external means (not shown) which may be a Rootes blower or similar device. The air blast passes into cylinder 4 by way of scavenge manifold 22 and the open scavenge port 21. Spent gases from the previous cycle are expelled to the exhaust manifold 24 by way of the open exhaust port 23. This air charge also acts as a coolant.

From B to C of FIG. 3, pistons 5 move inwards with substantially simple harmonic motion coming momentarily to rest again at C. Pistons 5 have now advanced along cylinder 4 shutting off ports 21 and 23. Trapped between pistons 5 is a volume of clean but cold air. As the pistons 5 approach point C, poppet valve 17 is opened under the action of cam 20.

From point C to D, tracks 3 are modified to cause pistons 5 to stop again for a given period of angular rotation. Cold air, which is supplied from the same source as the scavenge air, is injected with petrol or gas and flows to the charge and ignition chamber 14 by way of open poppet valve 17. This air/fuel mixture which contains a fuel rich ratio, will pass through orifice 15 into the lean combustion chamber 13 while poppet valve 17 remains open. The purpose of the two chambers 13 and 14 is to provide "stratification" for improved fuel economy and reduced toxic emissions. The air/fuel mixture remaining in the charge and ignition chamber 14 when poppet valve 17 closes is a small volume of fuel rich mixture capable of ignition by a spark plug 16. The larger fuel volume on passing into chamber 13 becomes diluted due to the presence of scavenge air which is trapped in combustion chamber 13 when ports 21 and 23 close. The diluted fuel/air mixture is not capable of ignition by a spark plug but will ignite following the ignition of the mixture in chamber 14. This avoids the need to have the entire mixture rich in fuel as in conventional systems and should lead to a 30% reduction in fuel consumption. Stratified combustion requires the fuel rich chamber 14 be small so as to prevent movement of the diluted mixture from combustion chamber 13 into chamber 14 during compression. The smaller the chamber, the less fuel consumed, as only a small quantity of rich mixture in close contact with the spark plug is required for ignition. Further, high temperature is largely confined to charge and ignition chamber 14 where combustion commences. The air in combustion chamber 13, being cold (and thus more dense than a hot charge), provides a high density charge and this leads to a very high volumetric efficiency. During this charging process, because ports 21 and 23 are closed by pistons 5, the combustion chambers undergo supercharge. The shape of track 3 during this phase determines the period of piston dwell. Accordingly, by an appropriate selection of track shape, it is possible to supercharge to any predetermined pressure thereby allowing the engine to operate at optimum pressure equivalent to the maximum safe compression ratio when burning petrol.

From points D to E, the pistons move inwards with simple harmonic motion. Poppet valve 17 closes early in this motion. Ignition takes place at E or just before as gases reach maximum compression at inner dead centre.

From points E to A, there is gas expansion in the combustion chamber and pistons 5 act upon the sinusoidal curves via connecting rods 6 and drive bearings 8 imparting a rotary motion to the wheels 2 and main shaft 1. It will be noted from FIG. 3 that a greater angular arc is given to expansion as compared to compression. This allows a greater period of time for combustion and hence to the imparting of energy to the main shaft 1.

As pistons 5 approach A, exhaust port 23 opens first, followed fractionally later by air scavenge port 21. The cycle as shown in FIG. 3 may be modified for specific applications as in piston aircraft engines. For this application, revs are restricted due to excessive propeller tip speeds. Hence maximum torque is desirable at the lowest possible engine revs. Therefore if the cycle shown in FIG. 3 represents 360°, it could be desirable to reduce A to A to 180° and supply two such cycles in 360°. This modification would double the torque output and halve the revs allowing a much more powerful engine to be installed at allowable propeller speed with substantial weight reduction.

The engine is capable of changing to diesel fuel consumption with little modification. This conversion, and the reverse conversion, could be executed in minutes. The cycle remains the same as for petrol or gas with the following exceptions.

From point C to D, it is necessary to provide for a higher compression ratio of at least 16:1. Accordingly, the air supplied must be increased in pressure to provide a higher supercharge. For this purpose, there may be provided a second blower to come into operation in series with the first. No fuel is admitted during this charge and provision must be made for isolating petrol and/or gas.

From points E to some point approaching A, diesel fuel is admitted by a conventional nozzle into the charge ignition chamber 14. For cold starting, a glow plug is fitted alongside the spark plug 16 or a combined spark plug - glow plug could be provided for this multi-fuel engine.

Figure 5:
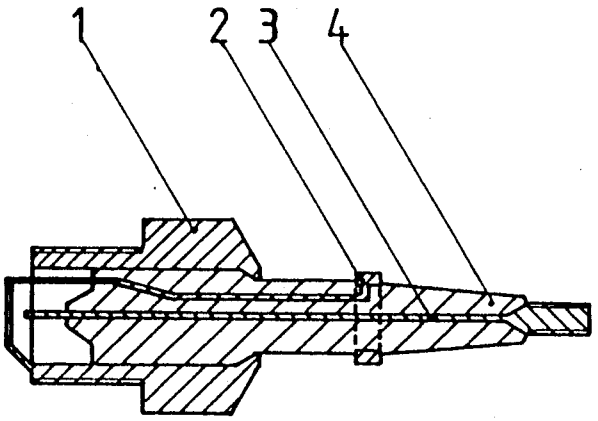
FIG. 5 is a sectional view of a combined spark plug-glow plug for use in a multi fuel engine.

The intended fuels to be used in a multi-fuel engine are methanol, natural gas, producer gas, petrol and diesel. The first four fuels require the provision of a spark plug, while diesel will require a glow plug. Both the spark and glow plugs need to be located in the fuel rich chamber, which, due to its small size presents a space problem. It is therefore expedient to combine both units into a normal size of spark plug. Such a device is shown in FIG. 5. When serving as a glow plug, heating current is introduced at 2 providing the necessary heat at the lower end of the electrode. The negative terminal for this current will be the plug body 1. When employed as a spark plug, high voltage current will flow through electrode 3 and spark to the common negative terminal 1.

When consuming diesel fuel, higher combustion chamber pressures are required. Compression of gases require additional rotational inertia. To supply the extra inertia, an external flywheel may be coupled to the drive shaft by, for example, magnetic coupling or fluid coupling or similar device.

Figure 4:
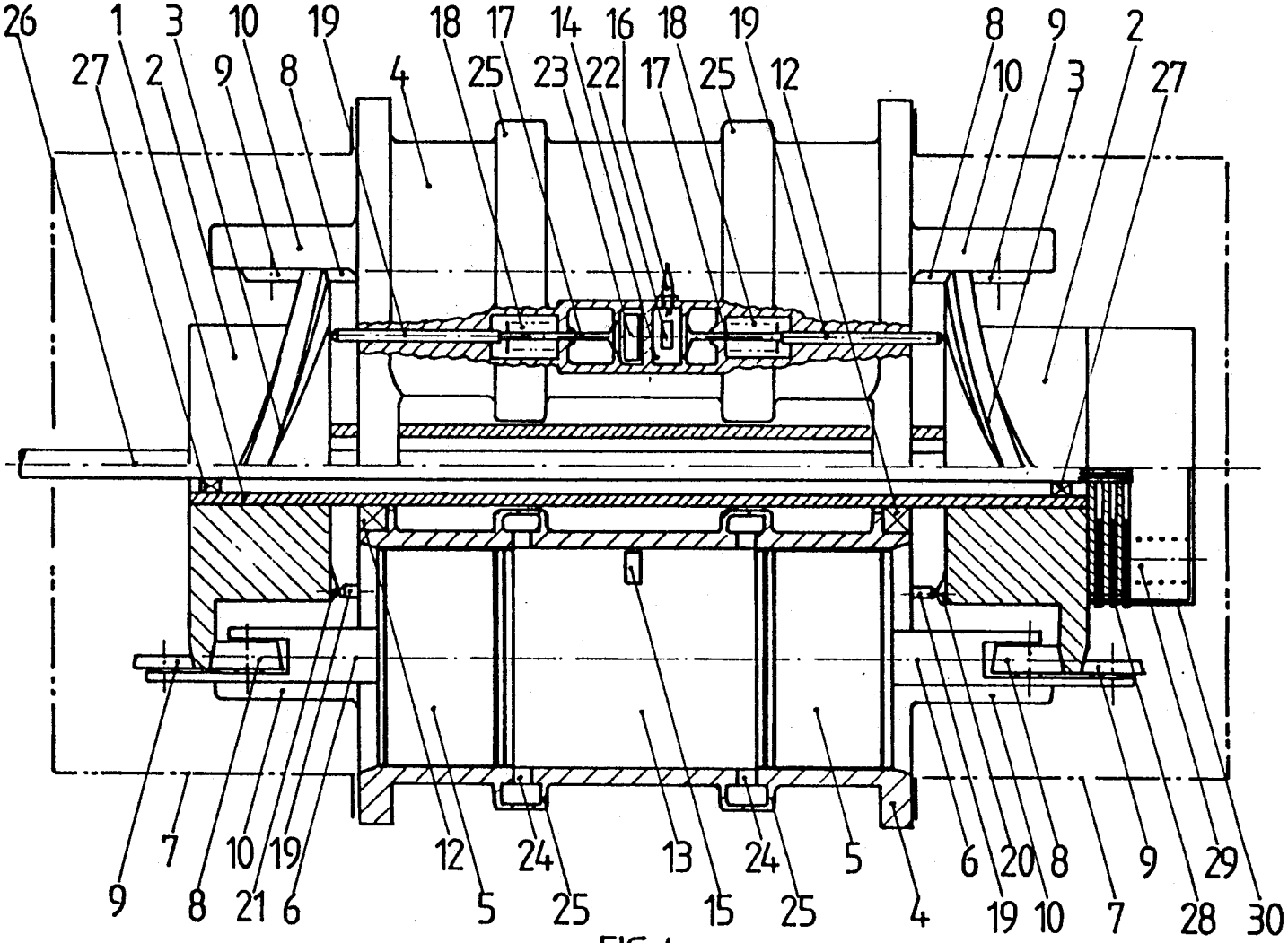
FIG. 4 is a view similar to that of FIG. 1 and illustrates a second internal combustion engine.

A second embodiment of the invention is illustrated in FIG. 4 which shows another internal combustion engine having two cylinders. Similar parts are given the same reference numeral as in FIG. 1.

In this embodiment, ports 24 are both exhaust ports and are symmetrically positioned with respect to cylinder 4 and communicate with exhaust manifolds 25. This allows more rapid exhausting of combustion chamber 13 at high speed and a more uniform heat dissipation.

The ignition components are as described in FIG. 1, except that the orifice from the fuel rich chamber 14 is referenced 22, spark plug 16 is mounted radially and its poppet valve 17 is controlled by cam 20 on right wheel 2. The admission of scavenge air is controlled by a similar arrangement. Scavenge air is now provided via a second spring loaded poppet valve 17 which is operated via push rod 19 by a cam 21 on the left hand wheel 2. After passing poppet valve 17, scavenge air flows through scavenge air orifice 23. The scavenge air orifice 23 is substantially larger than air/fuel orifice 22 to ensure free air flow for scavenging with a minimum of resistance. Further, during fuel charging, smaller air/fuel orifice 22 ensures separation of the rich and lean fuel mixtures for stratification. Orifices 22 and 23 join and lead to a common orifice 15 to combustion chamber 13.

The main shaft in this type of machine is highly stressed in axial tension and bending. The bending stress is more severe. To avoid this, in this embodiment main shaft 1 is made hollow and a second shaft 26 is mounted in bearings 27 at each end within hollow main shaft 1. Shaft 26 becomes the output shaft. A wet multi-plate clutch 28 with compression springs 29 is mounted within a clutch housing 30 on the right wheel 2. When clutch 28 is engaged, drive is conveyed from main shaft 1 to output shaft 26. This arrangement also allows the gearbox to become an integral part of the left sump located next to the left wheel 2. The overall effect is a significant shortening of the engine and the elimination of a number of oil seals generally regarded as a nuisance in conventional engines.

Only one main bearing 8 is employed and this is mounted between bifurcated arms of connecting rod 6. Tapering of flange 3, drive bearing 8 and tail bearing 9 is shown in FIG. 4.

Figure 6:
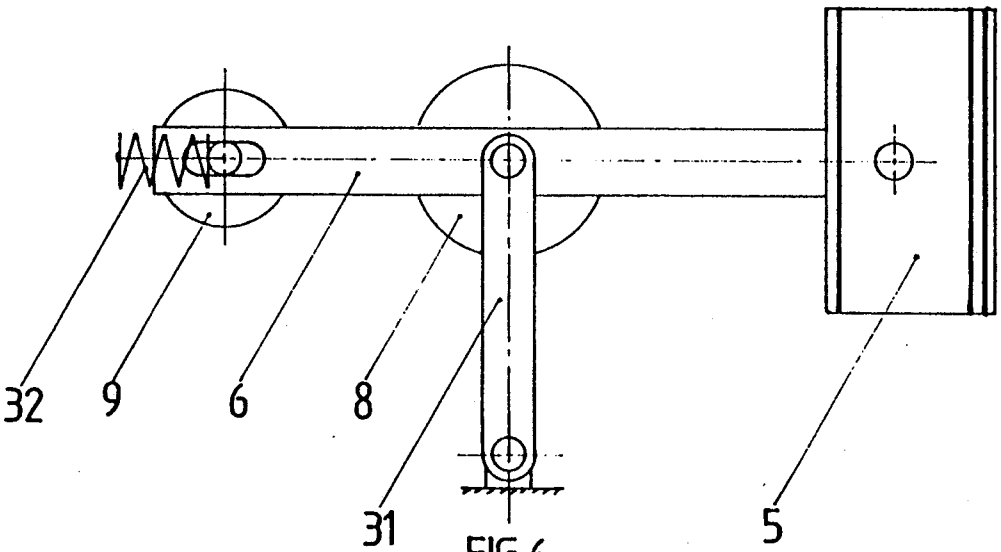
FIG. 6 illustrates an alternative connecting rod guide system to that shown in FIG. 2.

FIG. 6 illustrates an alternative guide system for connecting rod 6 which is favourable in terms of eliminating some moving parts A gudgeon pin is used to connect connecting rod 6 to piston 5. A robust rigid drag link 31 is at one end pivoted to part of cylinder 4. This end is preferably deepened and a long pivot pin is employed to eliminate any lateral movement of drag link 31. The other end of drag link 31 is pivoted to the pivot pin of drive bearing 8. The robust nature of drag link 31 and the pivoted connections at each end resist rotation of piston 5 in cylinder 4. Since the outer end of connecting rod 6 moves in a circular arc, tail bearing 9 is spring loaded at 32 to facilitate the drive bearing 8 and tail bearing 9 to negotiate the sinusoidal track.

It will be appreciated that the invention is not limited to the embodiments of the invention that have been described and illustrated in the accompanying drawings. Various changes and modifications within the broad scope of the invention described will be apparent to a person skilled in the art.

I claim:

1. A crankless reciprocating internal combustion engine comprising at least one cylinder, two opposed pistons arranged to reciprocate in opposite directions along the longitudinal axis of each cylinder, the pistons defining a common combustion chamber therebetween, a main shaft disposed parallel to, and spaced from, the longitudinal axis of each cylinder, two axially spaced, endless, substantially sinusoidal tracks carried by the main shaft for rotation therewith, said tracks being interconnected with said pistons so that reciprocation of the pistons imparts rotary motion to the main shaft, characterized in that said substantially sinusoidal tracks are axially spaced from each cylinder and each comprises a radially extending flange contoured in an axial direction to define the endless, substantially sinusoidal track, the radially extending faces of the flange forming opposed, axially facing, endless, substantially sinusoidal cam surfaces, a connecting rod connected at one end to each piston, bearing means carried toward the other end of said connecting rod, said bearing means abutting each of the two opposed axially facing cam surfaces, and further characterized in that the main shaft is hollow, an output shaft located within the hollow main shaft, and a clutch for conveying drive from the main shaft to the output shaft.

2. A crankless reciprocating internal combustion engine comprising at least one cylinder, two opposed pistons arranged to reciprocate in opposite directions along the longitudinal axis of each cylinder, the pistons defining a common combustion chamber therebetween, a main shaft disposed parallel to, and spaced from, the longitudinal axis of each cylinder, two axially spaced, endless, substantially sinusoidal tracks carried by the main shaft for rotation therewith, said tracks being interconnected with said pistons so that reciprocation of the pistons imparts rotary motion to the main shaft, characterised in that said substantially sinusoidal tracks are axially spaced from each cylinder and each comprises a radially extending flange contoured in an axial direction to define the endless, substantially sinusoidal track, the radially extending faces of the flange forming opposed, axially facing, endless, substantially sinusoidal cam surfaces, a connecting rod connected at one end to each piston, bearing means carried toward the other end of said connecting rod, said bearing means abutting each of the two opposed axially facing cam surfaces, and further comprising a fuel rich chamber in communication with the common combustion chamber and an ignition device located in the fuel rich chamber.

3. An internal combustion engine as claimed in claim 2, characterised in that it comprises two or more cylinders symmetrically disposed around the main shaft.

4. An internal combustion engine as claimed in claim 2, characterised in that it comprises two cylinders, the pistons in one cylinder operating 180 degrees out of phase with the pistons in the other cylinder.

5. An internal combustion engine as claimed in claim 2, characterised in that the flanges are the mirror image of one another.

6. An internal combustion engine as claimed in claim 2, characterised in that the bearing means comprises a drive bearing abutting one cam surface and a tail bearing abutting the opposed cam surface.

7. An internal combustion engine as claimed in claim 6, characterised in that each flange has a continuously variable thickness to match the spacing between the drive bearing and the tail bearing.

8. An internal combustion engine as claimed in claim 6, characterised in that the abutting faces of the flange, the drive bearing and the tail bearing are tapered to provide uniform relative velocity across the abutting faces.

9. An internal combustion engine as claimed in claim 2, characterised in that the engine is adapted to operate as a two stroke engine.

10. A two stroke internal combustion engine as claimed in claim 9, characterised in that it is arranged to operate as both a diesel engine and a gas or petrol engine, wherein a combined glow plug and spark plug is provided for fuel ignition.

11. A two stroke internal combustion engine as claimed in claim 9, characterised in that a scavenge air port and an exhaust port are provided in the cylinder wall, said ports being opened and closed by movement of the pistons in the cylinder.

12. A two stroke internal combustion engine as claimed in claim 11, characterised in that the ports are positioned so that the exhaust port opens before the scavenge air port.

13. A two stroke internal combustion engine as claimed in claim 11, characterised in that means are provided to admit fuel into the cylinder shortly after the scavenge air port is closed.

14. A two stroke internal combustion engine as claimed in claim 13, characterised in that the flanges are modified to cause the pistons to dwell while the cylinder is being scavenged with air and is being charged with fuel.

15. A two stroke internal combustion engine as claimed in claim 9, characterised in that exhaust ports are provided at axially spaced positions in the cylinder wall, said exhaust ports being opened and closed by movement of the pistons in the cylinder.

16. A two stroke internal combustion engine as claimed in claim 15, characterised in that means are provided to admit scavenge air into the cylinder.

17. A two stroke internal combustion engine as claimed in claim 16, characterised in that means are provided to admit fuel into the cylinder when the admission of scavenge air ceases.

* * * * *